United States Patent [19]

Steidinger

[11] Patent Number: 4,754,915

[45] Date of Patent: Jul. 5, 1988

[54] MAILER FORM SUITABLE FOR PRINTING AND METHOD

[75] Inventor: Donald J. Steidinger, Barrington, Ill.

[73] Assignee: WallaceComputer Services, Inc., Hillside, Ill.

[21] Appl. No.: 919,459

[22] Filed: Oct. 16, 1986

[51] Int. Cl.[4] ..... B65D 27/00

[52] U.S. Cl. ..... 229/92.7; 229/69; 229/73

[58] Field of Search ..... 229/92.7, 68 R, 69, 229/70, 73, 74

[56] References Cited

U.S. PATENT DOCUMENTS

| | | | |
|---|---|---|---|
| 2,723,078 | 11/1955 | Tilly | 229/73 |
| 3,255,952 | 6/1966 | Black | 229/73 |
| 3,303,987 | 2/1967 | Caine | 229/92.7 |
| 3,995,808 | 12/1976 | Kehoe | 229/92.7 |
| 4,044,942 | 8/1977 | Sherwood | 229/92.7 |
| 4,047,661 | 9/1977 | Klein | 229/70 |
| 4,397,417 | 8/1983 | Carlson | 229/70 |
| 4,487,360 | 12/1984 | Fisher et al. | 229/92.7 |

FOREIGN PATENT DOCUMENTS

| | | | |
|---|---|---|---|
| 2331244 | 6/1977 | France | 229/73 |

*Primary Examiner*—Willis Little

*Attorney, Agent, or Firm*—Tilton, Fallon, Lungmus & Chestnut

[57] ABSTRACT

A mailer form especially suited for printing as by laser, jet ink, etc. wherein a single sheet is adapted by the provision of a plurality of fold lines to have variable information printed on both the front panel and the message panel by folding to dispose the message panel interiorily while the mailer face panel is positioned exteriorily so the message panel is enclosed by the mailer face panel, mailer back panel and flap panel, and by virtue of side tear off stubs the mailer can be readily opened for access to the message panel by the recipient.

23 Claims, 2 Drawing Sheets

FIG. 1
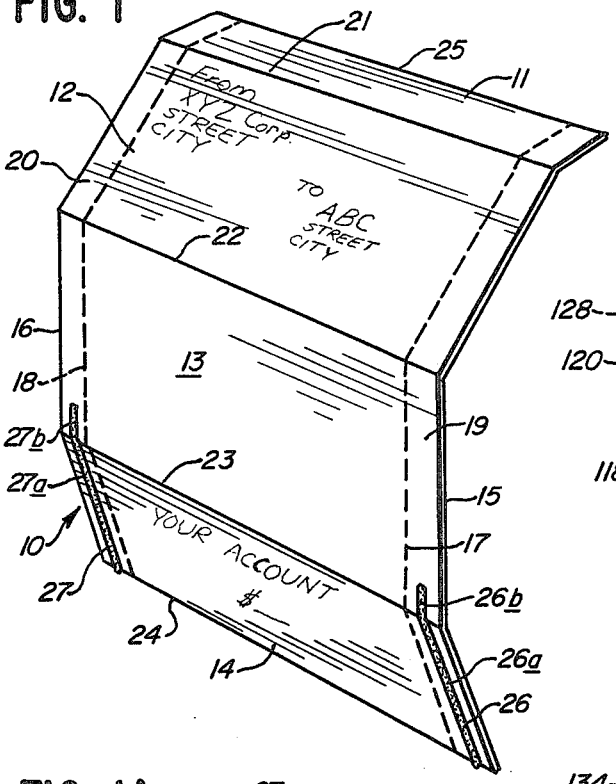
FIG. 2
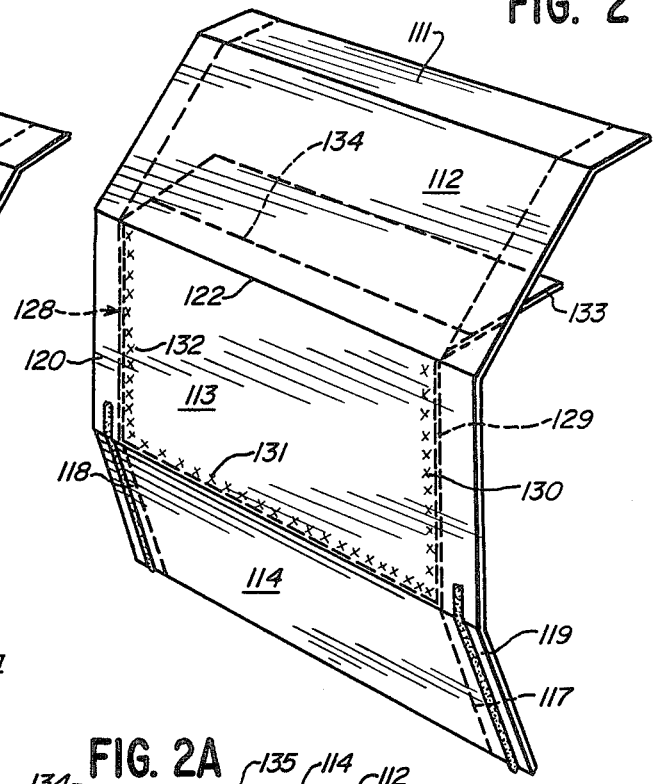
FIG. 1A
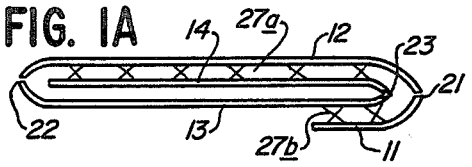
FIG. 2A
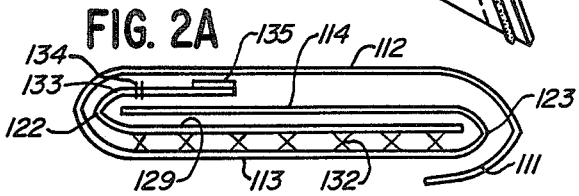
FIG. 2B
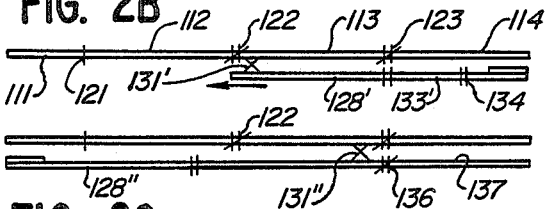
FIG. 2C
FIG. 3
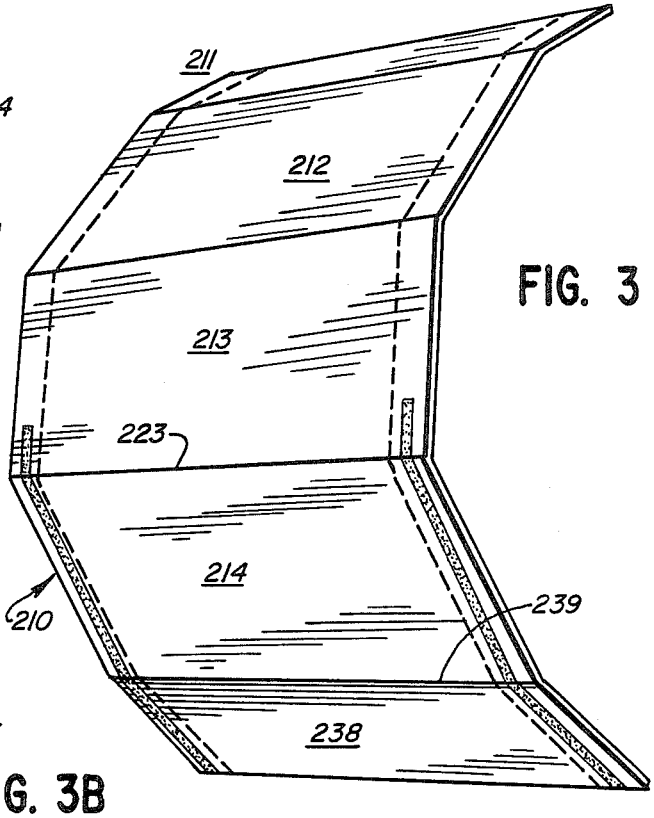
FIG. 3A
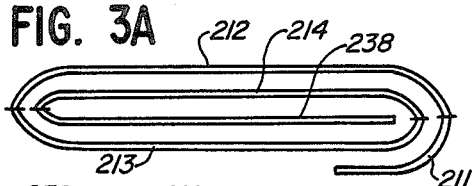
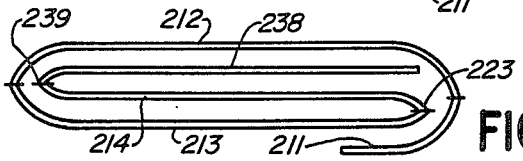
FIG. 3B

MAILER FORM SUITABLE FOR PRINTING AND METHOD

BACKGROUND AND SUMMARY OF INVENTION

This invention relates to a mailer form suitable for printing and a method of developing the same and, more particularly, a single message-ply mailer form advantageously employed in printing as by laser printing, ink jet printing, etc.

There is a need for a mailer form in business systems and promotional applications that can be used with non impact and particularly laser type computer printers.

The mailer forms exemplified by my earlier patents are all designed for impact type computer printers where an image produced on an outside office ply also makes an image on the face of the mailer envelope and on plies already inside the mailer envelope. These mailers are not suited for use with non impact computer printers or where an original computer printed image is desired on the message copy of the mailer.

The mailers that are subject of this invention are computer printed where they are essentially in the form of a single ply. This ply is then folded and glued in a way that will achieve several important objectives:

First, the mailer can be a single ply form without the need for die cut windows, window patching or glue patterns. This results in a low cost, easy to manufacture mailer.

Second, the absence of exposed glue patterns, rough edges of a window die cut, and loose edges of window patches results in a form that gives trouble free feeding and printing, particularly on laser printers.

The face of the envelope, back of the envelope, message area and even the flap are in position to receive computer print-out information. After folding, all the message areas are protected from handling wear and tear and for security of the information by portions of the mailer that are later to be discarded by the recipient.

Third, after computer print-out, the mailer can be folded conveniently on readily available paper folder thus avoiding the need for specialized equipment.

Fourth, the mailer is held in the folded condition for mailing by simple glue lines that are applied on the folder. It is also possible to provide glue patterns on the mailer form initially and to activate these glue patterns by means of moisture, heat or pressure.

Fifth, the folded mailer completely encloses the message portion so that it is secure from prying eyes.

Sixth, the folded mailer is easily opened by the recipient by removing a perforated stub at each end. It is also easy to remove and dispose of the non message portions of the mailer that are to be discarded.

The inventive mailer includes a flap panel, a face of the mailer panel, a back of the mailer panel, a message portion including one or more panels and two stub end portions. The single ply form can be printed and is perforated both horizontally and vertically before the form is computer printed. An interior cross perforation may be provided to facilitate the eventual separation of the message panels from the other portions which are to be discarded by the recipient. A vertical perforation near each side enables the recipient to remove the two end stubs in order to open the mailer. The invention also privides an advantageous return envelope construction.

Other objects and advantages of the invention may be seen in the details of the ensuing specification.

The invention is described in conjunction with the accompanying drawing, in which FIG. 1 is a perspective view of a mailer constructed according to the teachings of this invention;

FIG. 1A is a side elevational view of the folded mailer of FIG. 1;

FIG. 2 is a perspective view of a modified form of mailer which includes a return envelope and which is seen from the rear side;

FIG. 2A is a side elevational view of the mailer of FIG. 2 but in folded condition;

FIG. 2B is a side elevational view essentially schematic of the mailer of FIG. 2 but with a modified form of return envelope;

FIG. 2C is a view similar to FIGS. 2B but of another form of return envelope;

FIG. 3 is a perspective view of another form of mailer, this including two message panels;

FIGS. 3A and 3B are elevational views showing the mailer of FIG. 3 in two different fold configurations;

DETAILED DESCRIPTION

Figure 4:
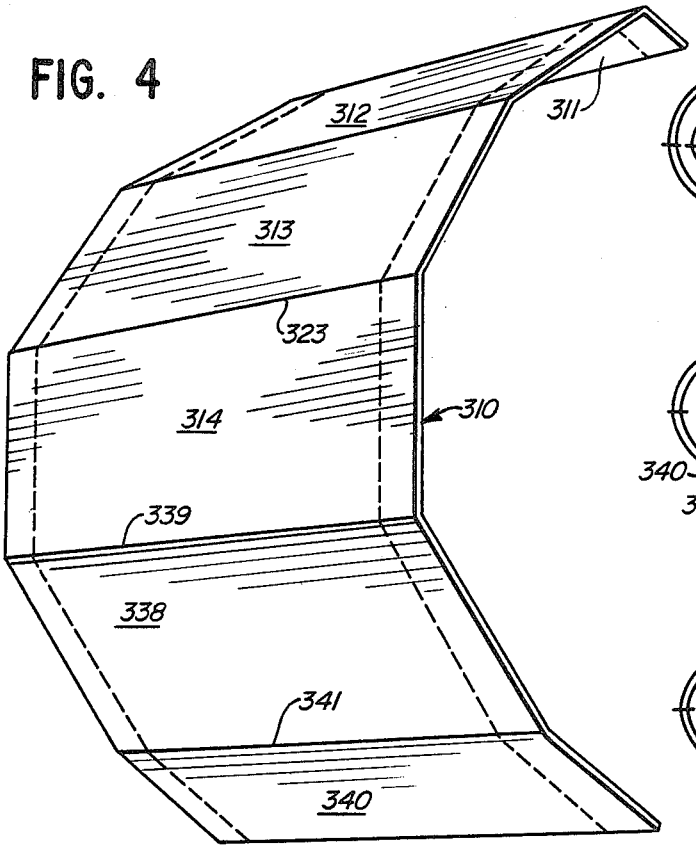
FIG. 4 is a perspective view of a five panel mailer.

In the illustrations given and with reference first to FIG. 1, the numeral 10 designates generally a mailer suitable for laser printing and the like which is constructed according to the teachings of this invention. The mailer 10 is a unitary paper sheet and is equipped with a plurality of fold lines dividing the sheet into four panels. The uppermost panel 11 ultimately becomes the flap of the mailer when it is sent out to the recipient.

Positioned immediately therebelow (in the illustration given) is the panel 12 which becomes the face of the mailer, i.e., the portion to be equipped with the addressee information. This normally varies from mailer to mailer.

Still proceeding downwardly in FIG. 1, the panel designated 13 ultimately becomes the back of the mailer when it is being sent out. The back of the mailer 13 and flap 11 are available for computer variable information such as customer account number, return address, promotional message, etc. Lastly, the bottom panel 14 will become the message panel on which other variable information will be printed—this along with the panel 12 which is the face of the mailer and it will be seen that the information to be imprinted thereon will occur on the same face of both panels 12 and 14.

The mailer as illustrated in FIG. 1 has two side edge portions 15 and 16 respectively and adjacent to but slightly inboard thereof are lines of perforation as at 17 and 18 defining tear off stubs 19 and 20.

Extending perpendicularly to the lines of perforation 17 and 18 are a plurality of transversely extending fold lines as at 21, 22 and 23. Fold lines 21 and 22 define the mailer face panel 12. Fold lines 22 and 23 define the mailer back panel 13. Fold line 23 with the sheet edge 24 define the message panel 14, and fold line 21 along with sheet edge 25 define the flap panel 11.

Operation Generally

The sheet 10 can be processed through a computer printer either in discreet form as shown or as part of a continuous web, with transverse separation occurring thereafter. In any event, the mailer 10 is normally computer imprinted in the panels 12 and 14 with variable information relating to the addressee and the particular message, respectively. Other panels are also available for computer imprinting.

After computer printout, the mailer is folded as illustrated in FIG. 1A. Referring now to FIG. 1A, the message panel 14 is seen in the central portion of that figure and is defined at one edge by the fold line 23. Positioned under the message panel 14 is the mailer back panel 13—by folding along the fold line 23. Thereafter, the face 12 of the mailer is positioned over the message panel 14 by folding around the fold line 22. Lastly, the flap 11 is positioned over the mailer back panel 13 by folding around the fold line 21.

Incident to this folding, adhesive is advantageously applied to the front face of the tear off stubs 19 and 20 as at 26 and 27 in FIG. 1. This results in the front face of the message panel 14 being adhered along its sides to the rear face of the front panel 12 as at 26A and 27A. It also results in the flap panel 11 being adhered to the back of the mailer as at 26B and 27B.

When the mailer is received by the recipient all he or she has to do is to tear off the two tear off stubs 19 and 20 whereupon the mailer can be unfolded. Normally, I provide a line of perforation along the fold line 23 so as to permit the message panel to be readily separated from the remainder of the mailer. This is particularly advantageous when a return envelope is provided within the mailer as can be seen in FIG. 2.

In FIG. 2, the numerals designating parts identical to those in FIG. 1 are given the same numeral but with the addition of 100. Hence, the flap panel is 111, the mailer front 112, the back 113 and the message panel 114. In like fashion, the tear off stubs are 119 and 120. Further, both the fold lines 122 and 123 include lines of perforation which permit not only detachment of the message panel 114 from the mailer back 113 but also detachment of the face of the mailer 112 from the back of the mailer 113. This results in the provision of the return envelope generally designated 128 (see also FIG. 2A).

The return envelope 128 is developed by using a patch or ply of paper secured to the rear or second face of the mailer, i.e., the side opposite to that receiving the computer printing. This advantageously is positioned between the stub foming perforations 117 and 118 and consists of two portions. The first portion 129 is secured to the back panel 113 by gluing along three sides as at 130, 131, and 132. The second portion 133 is not adhesively secured but underlies the mailer front 112 and is provided with a line of potential folding as at 134. Thus, it is possible for the recipient to return the message panel 114 by only folding the same once.

In use, the recipient detaches the return envelope which includes the mailer back 113 and the two portions 129 and 133 from the remainder of the mailer—by tearing along the lines of perforation 122 and 123. After insertion of the message panel 114, check, or other information piece, the return envelope 128 is closed by folding along the line 134 using adhesive that has been previously applied as at 135. This may be of the remoistable variety and the return envelope is now ready for mailing.

Two variations of the return envelope are available as presented in FIGS. 2B and 2C. In FIG. 2B a return envelope 128' is provided which is again attached to the back panel but with the glue line 131' reoriented so that when the mailer is processed through the computer in the direction of the arrow applied to FIG. 2B, there will be no possibility of the flap part 133' being caught.

In FIG. 2B, I have employed a single transverse line as at 121 to represent a fold line and a double transverse line as at 134 to represent a perforation line with strong bonds so that it is readily folded but not too easily broken. The third form of designation is a double line with a slash across as at 122 and 123 to indicate a line of perforation with very weak bonds so that separation is easily achieved.

In some instances, it may be advantageous to have the return envelope of the same length as the mailer, i.e., coextensive therewith and this is illustrated at 128" in FIG. 2C. This again is secured to the rear panel 113 by means of a line of transverse glue as at 131". I provide another line of perforation with weak bonds as at 136 for easy detachment of a portion of the second web—which provides the return envelope—but which is not needed when the return envelope is used. This additional portion 137 seen at the extreme right of FIG. 2C may carry advertising information, instructions, or the like.

Turning now to FIG. 3, a mailer form generally designated 210 is provided which is identical in most respects to that seen in FIG. 1—but with the exception of providing an additional message panel 238. The first and second message panels 214 and 238 are adapted to be separated from the remainder of the mailer by detachment along the line of perforation 223. This then provides the recipient with panels 214 and 238 which are separated by a fold line 239.

With the construction of FIG. 3, two folding configurations are available. In FIG. 3A I illustrate what could be considered a "continuous rollover" fold—where the mailer is essentially folded on itself as one would wind an element.

The other folding configuration is illustrated in FIG. 3B which embodies a form of "zig-zag" folding. In FIG. 3B, the message panel 238 is on top of the first message panel 214. Below the panel 214 is the back panel 213. Completing the mailer assembly is the front panel 212 and the flap 211.

In FIG. 3A, the second or bottom-most message panel 238 underlies the first message panel 214 after which the configuration is the same.

In FIG. 4 I illustrate a mailer 310 which has three message panels 314, 338 and 340. The line 323 separating the first message panel from the mailer back is advantageously a line of perforation whereas the line 339 between the first and second message panels 314 and 338 is a fold line—as is the line 341 between the second and third message panels 338 and 340.

Figure 4A:
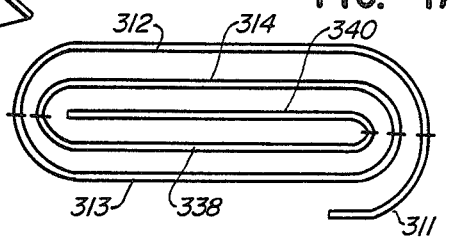
FIGS. 4A, 4B and 4C are side elevational views of three different fold configurations useful in connection with the mailer of FIG. 4.
Figure 4B:
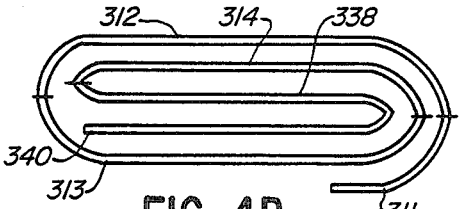
Figure 4C:
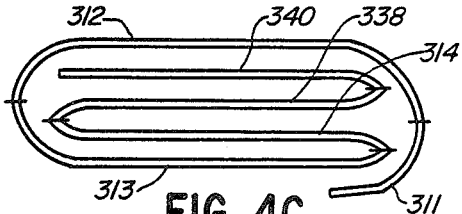

With three message panels, three folding variations are possible and these are illustrated in FIGS. 4A, 4B and 4C.

In FIG. 4A, the continuous rollover form characteristic of FIG. 3A is employed on the message panels.

In FIG. 4B, a combination of the rollover and zig-zag procedure is employed whereas in FIG. 4C the folding is of the zig-zag type on the message panels.

Figure 5:
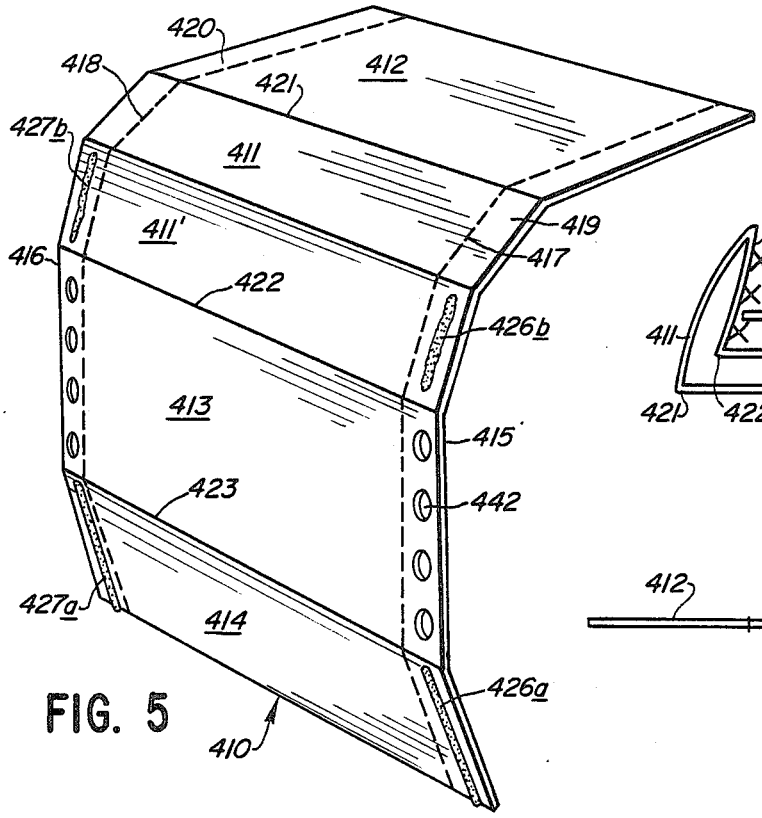
FIG. 5 is a perspective view of a mailer having a different type of flap configuration from that seen in FIG. 1 but also embodying three basic panels.

In the version of the invention presented in FIG. 5, I am able to provide two message panels. In the illustration given in FIG. 5 the face of the mailer is designated 412 and proceeding downwardly first and second flap portions 411 and 411′ are next encountered. The fourth panel down is designated by the numeral 413 and is available for a message imprinting, the same as is the back panel 414. Thus, I am able to use the mailerback panel as a second message panel.

By the provision of two intermediate flap panels 411 and 411′, I am able to provide the two message panels 413 and 414 while still achieving a confinement or enclosing of the message panels within the mailer. This can be appreciated from a consideration of FIG. 5A. There it will be seen that the rear of the message panel 414 now becomes the back of the folded mailer and next in proceeding downwardly is the message panel 413. The message panels 413 and 414 are separated by a fold line 423 which can also be seen in FIG. 5. The message panel 413 is also defined by a fold line 422 which is adjacent the flap 411′. The flaps 411 and 411′ are folded on themselves as can be appreciated from the left hand portion of FIG. 5A and folded behind the two message panels 413 and 414. The face panel 412 is folded under the message panel 413. The face panel 412 is defined in part by the fold line 421.

Again, the unitary sheet is equipped with lines of perforation 417 and 418 adjacent the longitudinal edges 415 and 416 respectively. This develops the tear off stubs 419 and 420.

Adhesive is provided as at 426*a* and 427*a* analogous to that found in the embodiment of FIG. 1. However, the portion of the glue stripe at 426*b* and 427*b* is positioned differently from that in FIG. 1, being on the front face of the second flap 411′.

Figure 5A:
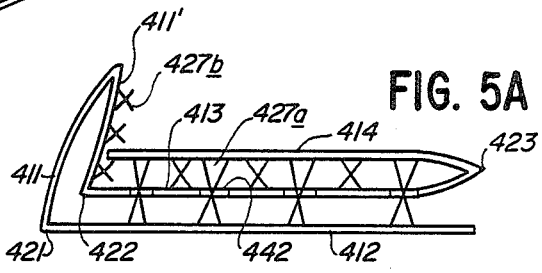
FIG. 5A is a side elevational view of the mailer of FIG. 5 in folded form.

By reference to FIG. 5A, it will be seen that the first glue line 427*a* is effective to adhere together the sides of the message panels 414 and 413. Then, by virtue of the glue provided at 427*b*, the flap 411′ is adapted to be secured to the unprinted face of the second messge panel 411. The sides of the front panel 412—in the stub portion—are secured to the remainder of the mailer by the adhesive 426*a* and 427*a* extending through the holes 442 in the first message panel 413.

Figure 5B:
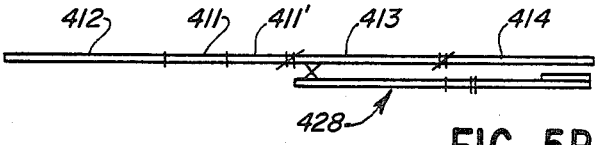
FIG. 5B is a side elevational view essentially schematic of the mailer of FIG. 5 but equipped with a return envelope.

In FIG. 5B I show a modified form of the mailer 410 which includes a return envelope 428. This showing is analogous to that found in FIG. 2B.

While in the foregoing specification a detailed description of an embodiment of the invention has been set down for the purpose of illustration, many variations in the details hereingiven may be made by those skilled in the art without departing from the spirit and scope of the invention.

I claim:

1. A mailer form suitable for one-side computer printing comprising a unitary paper sheet having a pair of parallel side edges and first and second faces, said sheet having at least three parallel fold lines extending perpendicularly to said side edges and forming at least four panels with each panel having an edge defined by a fold line, the first face of one panel being equipped with the addressee information of the mailer, and constituting the mailer front, the first face of at least one panel being equipped with a printed message, one panel constituting the mailer back, at least one panel constituting the mailer closure flap, and being folded into superposition on and attached to one of said front and back panels, a line of perforation perpendicular to said fold lines and adjacent each side edge to provide a tear off stub, and adhesive means on said stubs for securing said panels in superposed condition with said message panel being positioned inwardly of said mailer and the addressee panel being positioned outwardly of said mailer.

2. The mailer of claim 1 in which a return envelope is attached to said mailer second face.

3. The mailer of claim 1 in which a fold line defining said message panel is equipped with a line of perforation for detaching said message panel from the remainder of said mailer.

4. The mailer of claim 1 in which said mailer has four panels arranged in sequence to provide the mailer flap, the mailer front, the mailer back and the mailer message panel, said mailer first face being equipped with adhesive means in the stubs of said message panel and the contiguous portion of the stubs of said back panel whereby said contiguous portion adhesive means attaches said flap to said back panel.

5. The mailer of claim 4 in which a return envelope is attached to said mailer second face.

6. A mailer form suitable for one-side computer printing comprising a unitary paper sheet having a pair of parallel side edges and first and second faces, said sheet having at least three parallel fold lines extending perpendicularly to said side edges and forming at least four panels with each panel having an edge defined by a fold line, the first face of one panel being equipped with the addressee information of the mailer, and constituting the mailer front, the first face of at least one panel being equipped with a printed message, one panel constituting the mailer back, at least one panel constituting the mailer closure flap, and being folded into superposition on and attached to one of said front and back panels, a line of perforation perpendicular to said fold lines and adjacent each side edge to provide a tear off stub, and adhesive means on said stubs for securing said panels in superposed condition with said message panel being positioned inwardly of said mailer and the addressee panel being positioned outwardly of said mailer, said mailer haivng four panels arranged in sequence to provide the mailer flap, the mailer front, the mailer back and the mailer message panel, said mailer first face being equipped with adhesive means in the stubs of said message panel and the contiguous portion of the stubs of said back panel whereby said contiguous portion adhesive means attaches said flap to said back panel, a return envelope being attached to said mailer second face, said return envelope including a paper ply having a first portion attached to said back panel and an unattached second portion underlying said front panel.

7. The mailer of claim 6 in which said return envelope second portion is defined by a fold line underlying the fold line between said front and back panels, said second portion being equipped with a line of potential folding between said underlying fold line and the adjacent parallel edge of said ply to provide a flap for said return envelope, and adhesive means on said return envelope flap.

8. The mailer of claim 7 in which the fold lines defining said back panel are equipped with lines of perforation for separating said back panel from the remainder of said sheet whereby said back panel provides the back of said return envelope.

9. A mailer form suitable for one-side computer printing comprising a unitary paper sheet having a pair of parallel side edges and first and second faces, said sheet having at least three parallel fold lines extending perpendicularly to said side edges and forming at least four panels with each panel having an edge defined by a fold line, the first face of one panel being equipped with the addressee information of the mailer, and constituting the mailer front, the first face of at least one panel being equipped with a printed message, one panel constituting the mailer back, at least one panel constituting the mailer closure flap, and being folded into superposition on and attached to one of said front and back panels, a line of perforation perpendicular to said fold lines and adjacent each side edge to provide a tear off stub, and adhesive means on said stubs for securing said panels in superposed condition with said message panel being positioned inwardly of said mailer and the addressee panel being positioned outwardly of said mailer, said mailer having four panels arranged in sequence to provide the mailer flap, the mailer front, the mailer back and the mailer message panel, said mailer first face being equipped with adhesive means in the stubs of said message panel and the contiguous portion of the stubs of said back panel whereby said contiguous portion adhesive means attaches aid flap to said back panel, a return envelope being attached to said mailer second face, said return envelope including a paper ply having a first portion attached to said back panel and an unattached second portion underlying said message panel.

10. The mailer of claim 5 in which said return envelope is co-extensive with said mailer.

11. The mailer of claim 1 in which said mailer has at least five panels with at least two of said panels being message panels and arranged in series, connected relation.

12. The mailer of claim 11 in which said five panels are arranged in sequence to provide the mailer flap, the mailer front, the mailer back, and first and second message panels, the fold line between said mailer back and said first message panel including a line of perforation for separating said first and second message panels from the remainder of said sheet.

13. The mailer of claim 11 in which said five panels are arranged in sequence to provide the mailer face, first and second flap panels and first and second message panels, the second face of said second message panel constituting the back of said mailer.

14. The mailer of claim 13 in which said adhesive means is provided on the front face of the stubs of said second message panel and said second flap panel.

15. The mailer of claim 13 in which the fold line between the second flap panel and said first message panel includes a line of perforation.

16. The mailer of claim 15 in which the fold line between said third and fourth panels is a line of perforation, a paper ply having a first portion adhered to said first message panel second face and having a second portion underlying said second message panel to provide a return envelope.

17. A mailer form suitable for printing comprising a unitary paper sheet having a pair of parallel side edges, said sheet having at least three parallel fold lines extending perpendicularly to said side edges and forming at least four panels, each panel having an edge defined by a fold line, one panel being suited for the addressed face of the mailer, at least one panel being suited for a printed message, one panel being suited for the back of the mailer, at least one panel being suited as a closure flap for the mailer, whereby all the panels can receive printing on one face of the sheet and the message panels are foldable to face the inside of the mailer, the addressed face of the mailer being foldable to face the outside of the mailer, the flap panel being foldable for attachment to one of said front and back panels to enclose the printed face of the message panel interiorily of the mailer, and a line of perforation perpendicular to the fold lines and adjacent each edge of the sheet to provide a tear off stub, and adhesive means on said stub between each line of perforation and its adjacent edge.

18. A mailer form suitable for printing comprising a unitary paper sheet having a pair of parallel side edges, said sheet having at least three parallel fold lines extending perpendicularly to said side edges and forming at least four panels, each panel having an edge defined by a fold line, one panel being suited for the addressed face of the mailer, at least one panel being suited for a printed message, one panel being suited for the back of the mailer, at least one panel being suited as a closure flap for the mailer, whereby all the panels can receive printing on one face of the sheet and the message panels are foldable to face the inside of the mailer, the addressed face of the mailer being foldable to face the outside of the mailer, the flap panel being foldable for attachment to one of said front and back panels to enclose the printed face of the essage panel interiorly of the mailer, and a line of perforation perpendicular to the fold lines and adjacent each edge of the sheet to provide a tear off stub, and adhesive means on said stub between each line of perforation and its adjacent edge, a return envelope being attached to that face of the sheet opposite to the printed face of the message panel, said return envelope having a first portion attached along three contiguous sides to a panel between stubs and a second portion underlying an adjacent panel but unsecured thereto.

19. A method of developing a mailer imprinted with variable information comprising:

providing a single unitary sheet having a line of potential severance extending thereacross defining a message panel with an addressee panel in the remainder of said sheet, said sheet also having stub providing lines of perforation adjacent a pair of opposite sheet edges and extending perpendicularly to said line of potential severance, printing one face of said sheet with variable information on said message and addressee panels, folding said sheet on itself a plurality of times to position said message panel interiorly of said mailer and said addressee panel exteriorly of said mailer, and adhering said sheet to itself in said stubs.

20. The method of claim 19 in which said printing is performed by laser means.

21. A method of developing a mailer imprinted with information on one face thereof comprising providing a single unitary sheet eventually divided into front and back mailer panels, at least one message panel and a flap panel as determiend by spaced apart parallel fold lines, said sheet also having stub-providing lines of perforation adjacent a pair of opposite sheet edges and extending perpendicular to said fold lines, printing said one face of said sheet on said message and front panels, folding said sheet on itself a plurality of times to position said message panel interiorily of said mailer with the back and front mailer panels exteriorily and a flap portion over onto one of either of said front or back panels and adhering said sheet to itself in said stubs.

22. The method of claim 21 in which said mailer is equipped with a plurality of message panels, said message panels being continuously rollover folded.

23. The method of claim 21 in which said mailer is equipped with a plurality of message panels, said message panels being zig-zag folded.

* * * * *